US009210973B2

(12) United States Patent
Benjano

(10) Patent No.: US 9,210,973 B2
(45) Date of Patent: Dec. 15, 2015

(54) GEMSTONE CUT GRADING METHOD AND APPARATUS

(75) Inventor: Daniel Benjano, Ramat-Gan (IL)

(73) Assignee: DANOG PROPERTY AND INVEST LTD., Ramat Gan (IL)

( * ) Notice: Subject to any disclaimer, the term of this patent is extended or adjusted under 35 U.S.C. 154(b) by 335 days.

(21) Appl. No.: 13/597,271

(22) Filed: Aug. 29, 2012

(65) Prior Publication Data

US 2014/0067331 A1 Mar. 6, 2014

(51) Int. Cl.

| | |
|---|---|
| ***G06F 17/50*** | (2006.01) |
| ***A44C 27/00*** | (2006.01) |
| ***A44C 17/00*** | (2006.01) |

(52) U.S. Cl.

CPC ..... *A44C 27/00* (2013.01); *A44C 17/001* (2013.01)

(58) Field of Classification Search

None

See application file for complete search history.

(56) References Cited

U.S. PATENT DOCUMENTS

| | | | | |
|---|---|---|---|---|
| 5,966,673 | A * | 10/1999 | Shannon, Sr. | 702/35 |
| 6,239,867 | B1 * | 5/2001 | Aggarwal | 356/30 |
| 6,567,156 | B1 * | 5/2003 | Kerner | 356/30 |
| 7,136,154 | B2 * | 11/2006 | Bray | 356/30 |
| 7,193,694 | B2 * | 3/2007 | Underwood | 356/30 |
| 2005/0200834 | A1 * | 9/2005 | Sasian et al. | 356/30 |
| 2008/0231833 | A1 * | 9/2008 | Shlezinger et al. | 356/30 |
| 2010/0250201 | A1 * | 9/2010 | Sivovolenko | 703/1 |

OTHER PUBLICATIONS

D.F. Huber, M. Hebert (Jul. 1, 2003). "Fully automatic registration of multiple 3D data sets," Image and Vision Computing 21 (7), 637-650.*

* cited by examiner

*Primary Examiner* — Omar Fernandez Rivas
*Assistant Examiner* — Bijan Mapar
(74) *Attorney, Agent, or Firm* — Mark M. Friedman

(57) ABSTRACT

A system for controlling the cut of a gemstone includes a gemstone scanner adapted to scan a plurality of facets of an actual gemstone so as to determine facet parameters pertaining to each one of the plurality of facets. The system also includes a control module operatively coupled to the gem scanner and adapted to receive the determined facet parameters of the plurality of facets of the gemstone. The control module generates an actual 3D model of the actual gemstone from determined facet parameters and an idealized 3D model for an idealized gemstone. The control module compares the actual 3D model with the idealized 3D model to determine leakage values for facet parameters of each one of the facets of the gemstone such that the leakage value is used to control the cut of the gemstone. A method implemented by the system is also disclosed.

10 Claims, 7 Drawing Sheets

GEMSTONE CUT GRADING METHOD AND APPARATUS

FIELD OF THE INVENTION

The present disclosure broadly relates to the field of gemstone grading and more particularly to system and method for controlling the cut of a gemstone.

BACKGROUND OF THE INVENTION

Generally, the value of a precious gemstone, such as, but not limited to, diamond, may be influenced by various characteristics, including, as an example, clarity, cut, color and carat weight. Out of these parameters, cut of a gemstone may play an important role in determining its brilliance and, as a result, may affect its value. Brilliance is the ability of the gemstone to reflect light, thereby producing a shining effect. The ability of the diamond to reflect light depends upon the symmetry of its cut. Cut refers to a geometric proportions of a gemstone as well as to a final form into which the rough gemstone is shaped, i.e. sizes and inclinations of various facets produced during cutting, or polishing of the gemstone. Since brilliance may be easily noticed by a naked eye, the cut of the gemstone may be important. Particularly, there is a requirement to maintain the symmetry of the various facets during the cutting process so as to enable the gemstone to exhibit good brilliance.

The conventional techniques for ascertaining the symmetry of the various facets may require manual inspection, in an iterative manner, so as to control the cut of each of the facet. However, such manual inspection may be time consuming, labour intensive and may be vastly dependent on human skills. Accordingly, it may be difficult to achieve the desired symmetry on a consistent basis Accordingly, there exists a need for a technique for controlling the cut of a gemstone in a manner so as that symmetry may be achieved between the various facets of the gemstone.

There further exists a need for a system for controlling the cut of a gemstone in a manner so that symmetry may be achieved between the various facets thereof. Particularly, there exists a need for a system that may help in reducing the human labour involved in the conventional method to control the cut of a gemstone.

SUMMARY OF THE INVENTION

In The following disclosure, aspects thereof are described and illustrated in conjunction with systems and methods which are meant to be exemplary and illustrative, not limiting in scope. The present disclosure may be further directed to a method of utilization and/or usage of such apparatuses.

According to an aspect of the present disclosure, a system for controlling the cut of a gemstone is disclosed. The system comprises a gem scanner adapted to scan plurality of actual facets of an actual gemstone and determine scanned facet parameters pertaining to each of the plurality of actual facets. The system also comprises a control module communicably coupled to the gem scanner and adapted to receive the determined scanned facet parameters of the plurality of actual facets of the actual gemstone. The control module may be adapted to generate an actual 3D model for the actual gemstone from the scanned facet parameters and an idealized 3D model for an idealized gemstone by considering idealized facet parameters of idealized facets thereof. Also, the control module may be adapted to compare the actual 3D model with the idealized 3D model to determine leakage values for scanned facet parameters of each of the actual facets of the actual gemstone. The leakage value may be used to control the cut of the actual gemstone.

In an embodiment of the present invention, the plurality of actual facets may be selected from a group consisting of crown facet, pavilion facet, star facet, lower half facet, happer girdle facet and table facet.

In another embodiment of the present invention, the idealized 3D model may be generated by averaging idealized facet parameters of idealized facets of same kind and normalizing all idealized facets of the same kind to the averaged idealized facet parameter.

In yet another embodiment of the present invention, the scanned and idealized facet parameters may comprise areas and angles.

In still another embodiment of the present invention, the control module may be adapted to compare the actual 3D model with the idealized 3D model by generating first set of two dimensional models for each of the plurality of actual facets of the actual gemstone from the actual 3D model and a second set of two dimensional models for the corresponding idealized facets of idealized gemstone from the idealized 3D model. The Control module may be further adapted to superimpose the first set of two dimensional models over corresponding second set of two dimensional models so as to determine an overhanging region therebetween such that the overhanging region may represent the leakage value for the scanned facet parameters of each of the plurality of actual facets.

In still another embodiment of the present invention, the leakage value may represent a difference between the scanned facet parameter of actual facets of the actual gemstone and corresponding idealized facets of the idealized gemstone.

According to another aspect of the present disclosure, a method for controlling the cut of a gemstone is disclosed. The method comprises scanning a plurality of actual facets of an actual gemstone and determining scanned facet parameters pertaining to each of the plurality of actual facets, generating an actual 3D model for the actual gemstone from the determining facet parameters and an idealized 3D model for an idealized gemstone and comparing the actual 3D model with the idealized 3D model to determine leakage values for actual facet parameters of each of the actual facets of the actual gemstone. The method also comprises using the leakage value to control the cut of the actual gemstone.

In an embodiment of the present invention, generating the idealized 3D model may comprise averaging idealized facet parameters of idealized facets of same kind and normalizing all idealized facets of the same kind to the averaged idealized facet parameter.

In another embodiment of the present invention, comparing the actual 3D model with the idealized 3D model may comprise generating first set of two dimensional models for each of the plurality of actual facets of the actual gemstone from the actual 3D model and a second set of two dimensional models for the corresponding idealized facets of the idealized gemstone from the idealized 3D model, and superimposing the first set of two dimensional models over corresponding second set of two dimensional models so as to determine an overhanging region therebetween. The overhanging region may represent the leakage value for the scanned facet parameters of each of the plurality of actual facets.

In yet another embodiment of the present invention, controlling the cut of the gemstone based on the leakage value may comprise cutting each of the actual facets so as to make the scanned facet parameters thereof similar to that of the corresponding idealized facets of the idealized gemstone.

In addition to the exemplary aspects and embodiments described above, further aspects and embodiments will become apparent by reference to the figures and by study of the following detailed descriptions.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views.

It should also be noted that, for ease of understanding, that a particular shape, or cut of the gemstone, may be referred to, however, the invention is applicable to any cut having at least one symmetrical axis.

Figure 1A:
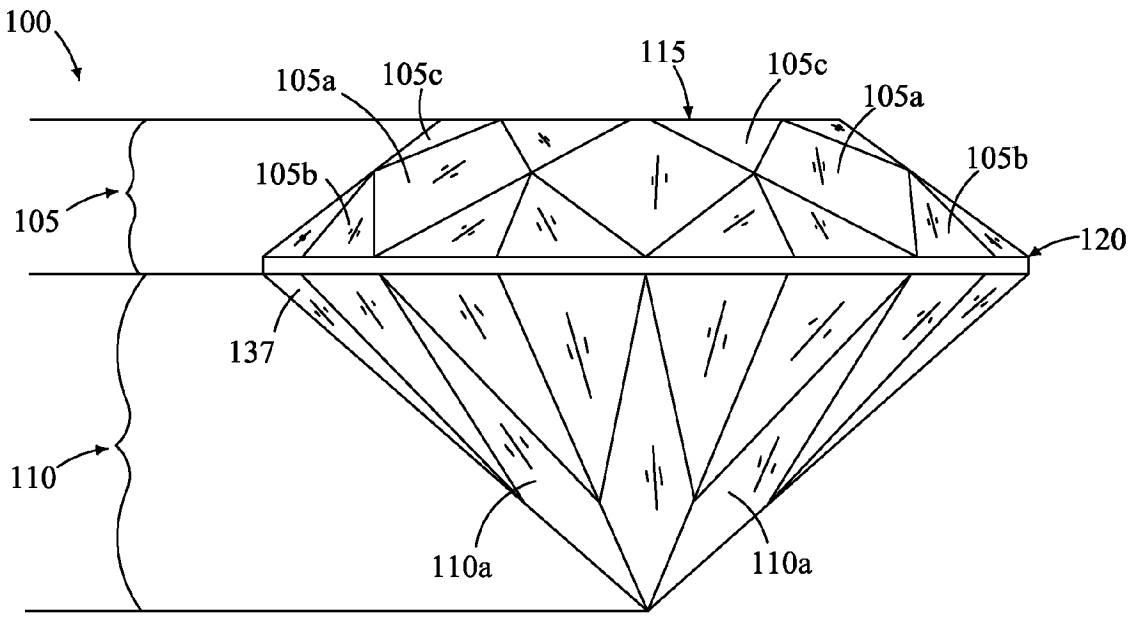
Figure 1B:
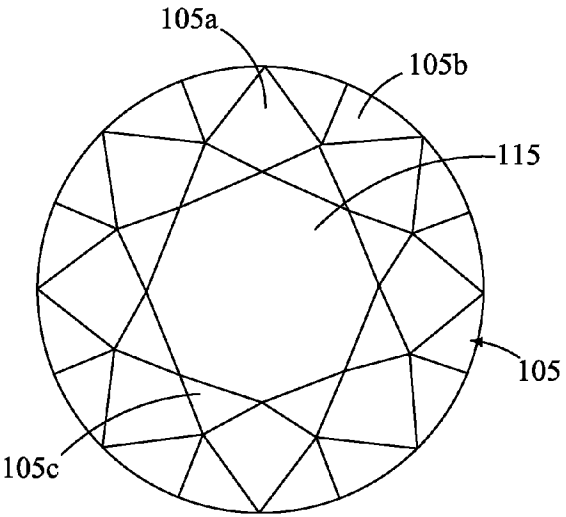
Figure 1C:
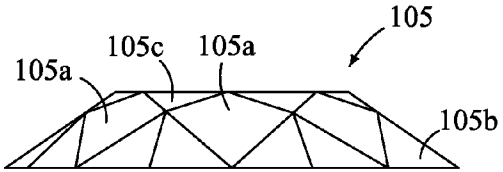
Figure 1D:
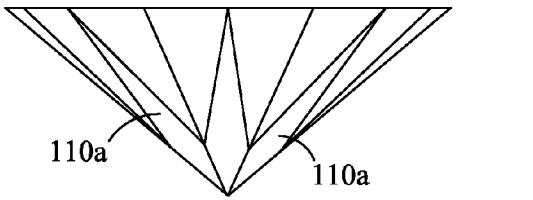
Figure 2:
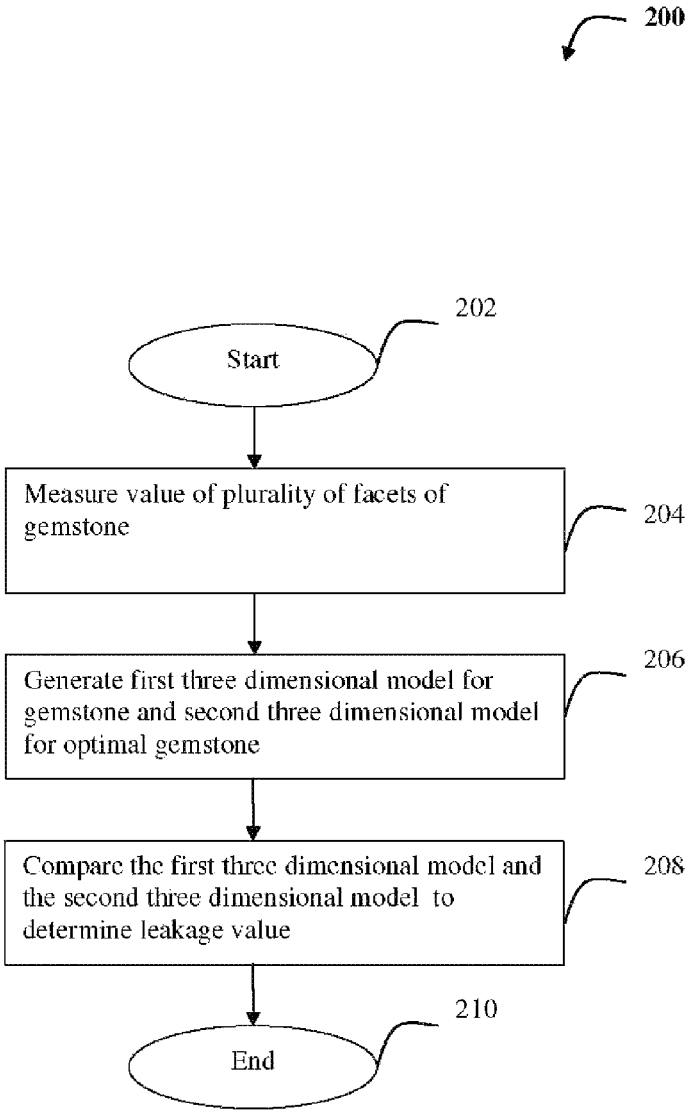
Figure 3:
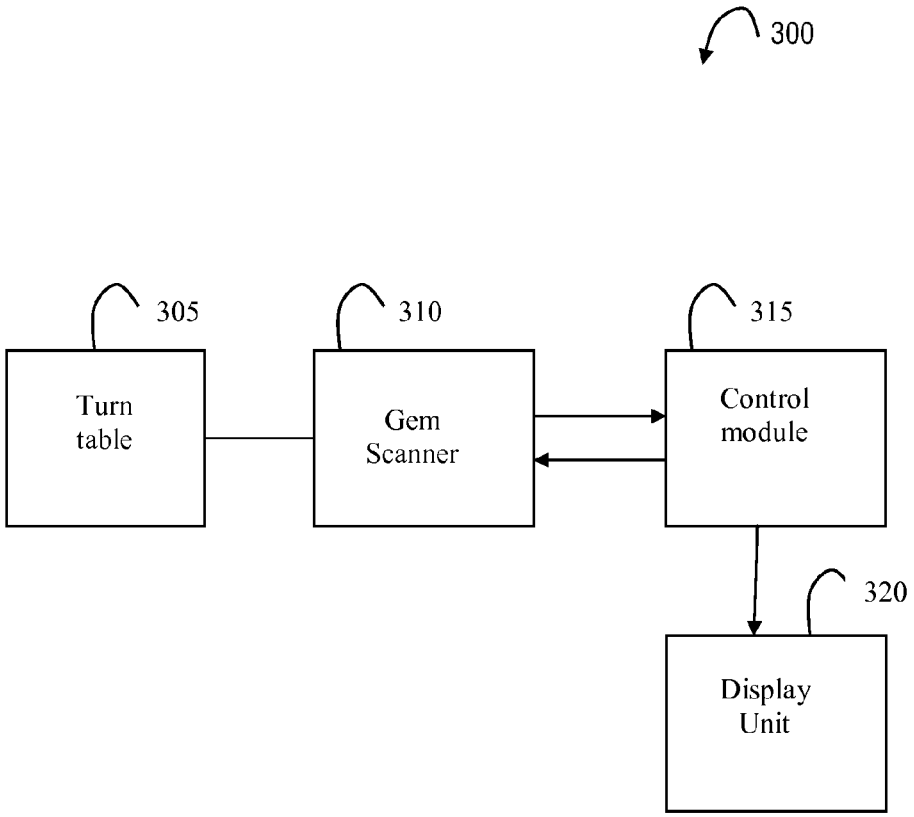
Figure 4A:
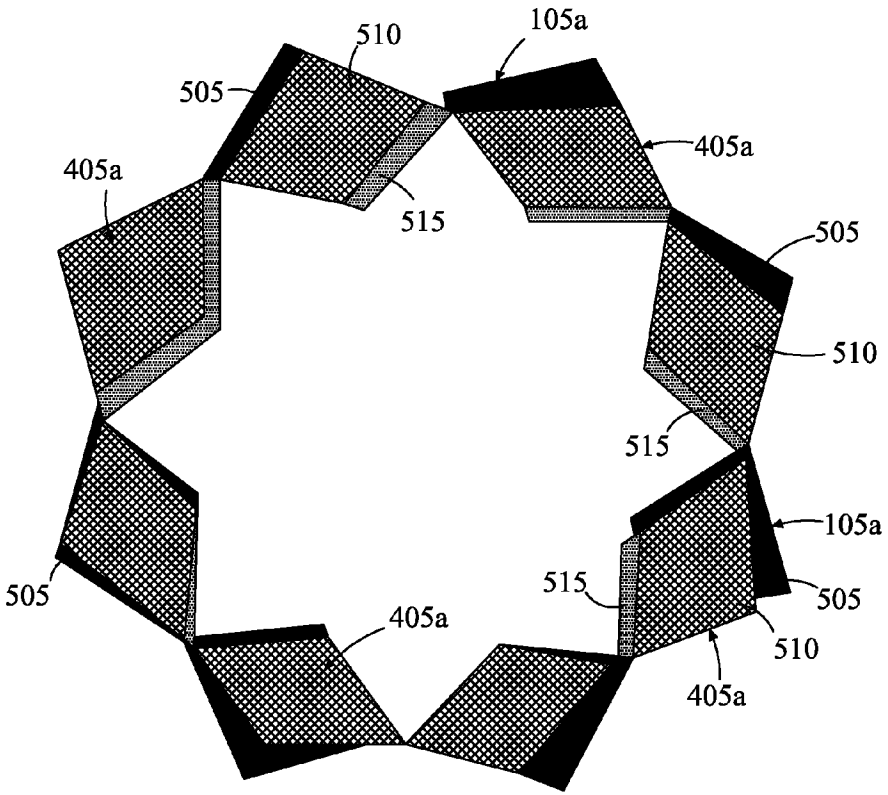
Figure 4B:
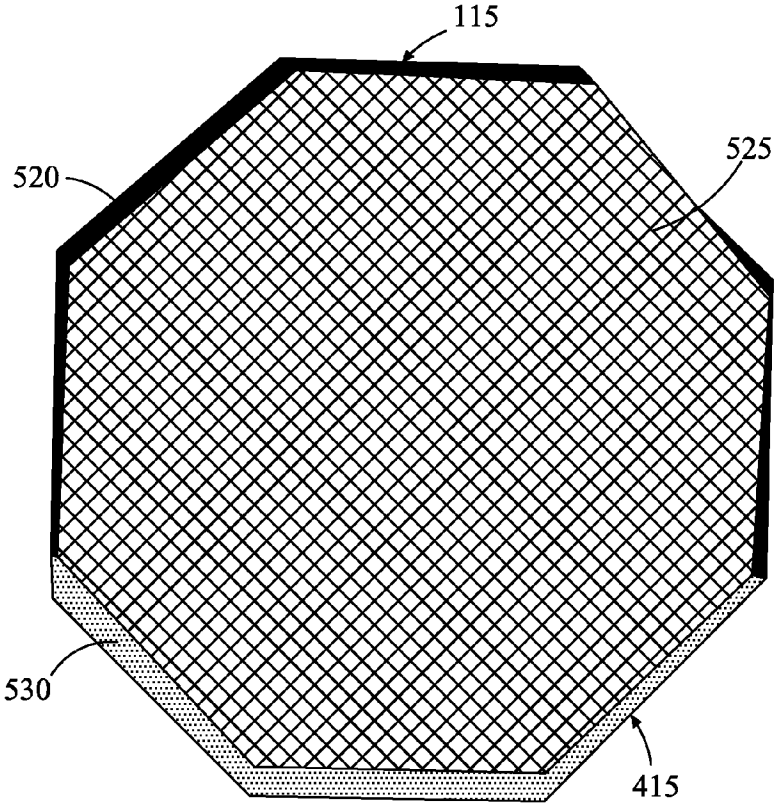
Figure 4C:
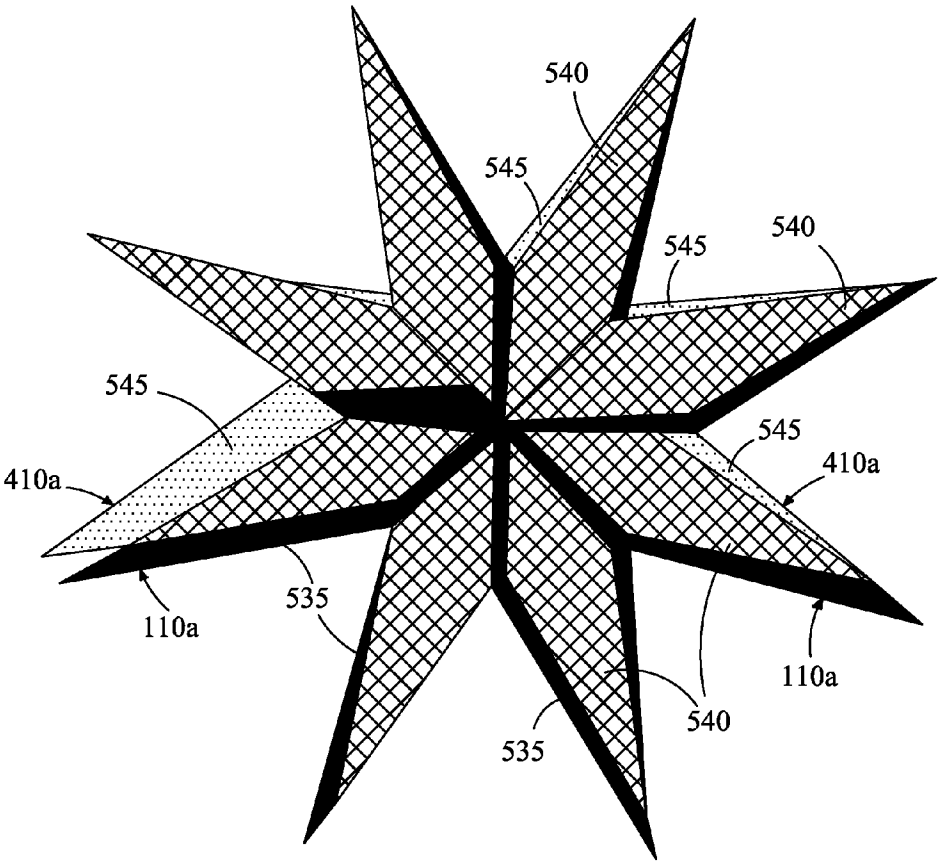

Reference will now be made to the accompanying drawings, wherein:

FIG. 1*a* schematically illustrates a general gemstone having pavilion, crown and table facets;

FIG. 1*b* schematically illustrates a top plan view of the general gemstone as shown in FIG. 1*a*, depicting the table facet;

FIG. 1*c* schematically illustrates a side view of the upper portion of the general gemstone as shown in FIG. 1*a*, depicting the crown facets;

FIG. 1*d* schematically illustrates a side view of the lower portion of the general gemstone as shown in FIG. 1*a*, depicting the pavilion facets;

FIG. 2 is a flow chart illustrating a method for depicting the gemstone in connection with the cutting of the actual gemstone in accordance with an embodiment of the present invention;

FIG. 3 is a block diagram of the system for implementing the method as illustrated within FIG. 2;

FIG. 4*a* illustrates a two dimensional model of the crown facets of an actual gemstone superimposed over that of the corresponding crown facets of an idealized gemstone;

FIG. 4*b* illustrates a two dimensional model of the table facet of the actual gemstone superimposed over that of the corresponding table facet of an idealized gemstone; and FIG. 4*c* illustrates a two dimensional model of the pavilion facets of the actual gemstone superimposed over that of the pavilion facets of an idealized gemstone.

DETAILED DESCRIPTION OF THE ILLUSTRATED EMBODIMENTS

As required, a schematic, exemplary embodiment of the present apparatus and method are disclosed herein, however, it is to be understood that the disclosed embodiment is merely exemplary of the present invention, which may be embodied in various and/or alternative forms. Specific structural and functional details disclosed herein are not to be interpreted as limiting, but merely as a basis for the claims and as a representative basis for teaching one of ordinary skill in the art to variously employ the present invention in virtually any appropriately detailed structure.

Aspects, advantages and/or other features of example embodiments of the invention will become apparent in view of the following detailed description which discloses various non-limiting embodiments of the invention. In describing exemplary embodiments, specific terminology is employed for the sake of clarity. However, the embodiments are not intended to be limited to this specific terminology. It is to be understood that each specific element includes all technical equivalents that operate in a similar manner to accomplish a similar purpose.

Exemplary embodiments may be adapted for many different purposes and are not intended to be limited to the specific exemplary purposes set forth herein. Other non-limiting examples of such embodiments are compositions that may be used, for example, for structural components. Those of ordinary skill in the art would be able to adapt the embodiments of the present invention, depending for example, upon the intended use of the embodiment.

All directional references (for example, upper, lower, upward, downward, left, right, leftward, rightward, top, bottom, above, below, vertical, horizontal, clockwise, and counterclockwise) are only used for orientation purposes in order to aid the reader's understanding of the present disclosure, and may not create limitations, particularly as to the position, orientation, or use of the apparatus and/or method disclosed herein. Joinder references (for example, attached, coupled, connected, hinged, and the like) are to be construed broadly and may include intermediate members between a connection of elements and relative movement between elements. As such, joinder references do not necessarily infer that two elements are directly connected and in fixed relation to each other.

While the invention can be used to test and measure any conceivable gemstone cut having at least one symmetrical plane and/or axis, a commonly recognized cut is employed in the following description to ease understanding by referring to a commonly known shape of the gemstone. Commonly, a schematic gemstone may have a generally conical (or frusto-conical) prismatic shape pavilion comprising a plurality of pavilion facets. A large base of the pavilion may merge with a generally frusto-conical prism shaped crown, the crown comprising a plurality of crown facets and terminating at a generally polygonal table. FIG. 1*a* illustrates a general gemstone 100 that comprises a crown 105, a pavilion 110, a table 115 and a girdle 120. As shown, the girdle 120 may be a peripheral rim-like portion that separates the crown 105 and the pavilion 110. The table 115 may be the flat top face of the crown 105. The table 115 is clearly depicted in FIG. 1*b* which is a top plan view of the gemstone 100 of FIG. 1*b*. As shown, the table 115 may form the top flat face of the crown 105. FIG. 1*c* illustrates a side view of the crown 105. As shown in FIGS. 1*a*, 1*b* and 1*c*, the crown 105 may be made up of a number of crown facets 105*a*, 105*b* and 105*c*. Furthermore, FIG. 1*d* illustrates a side view of the pavilion 110 comprising a number of pavilion facets 110*a*. Thus, as shown in FIGS. 1*a, b, c* and *d*, the gemstone 100 may be made up of a number of facets of different shapes and sizes, which may help in the total internal reflection of light entering through the various facets. More particularly, as the light rays falling upon the table 115 reach the pavilion 110, the light rays may be totally reflected and may escape from the crown 105, thereby producing brilliance. As mentioned earlier, the brilliance of the gemstone 100 may depend upon a good cut and it is with this aim that the present invention envisages to control the cut so as to produce the desired brilliance in a gemstone.

The invention shall now be explained with reference to a method 200 as illustrated in FIG. 2 for assessing the cut of an actual gemstone. The method 200 shall also be explained in conjunction with FIG. 3 that comprises a block diagram of the system 300 for implementing the method 200. As shown in FIG. 3, the system 300 includes a turntable 305 adapted to hold the actual gemstone thereon. The turntable 305 may be any turntable, which may be known or discovered, having a support (not shown) to hold the actual gemstone thereon, the support being rotatable about an axis. Furthermore, the system 300 includes a gem scanner 310 adapted to scan a plurality of facets of the actual gemstone and to determine the facet parameters (such as size, angle, and the like) pertaining to each one of the plurality of facets thereof, as is well-known in the art. The facet parameters determined by scanning the plurality of facets of the actual gemstone may be henceforth referred to as the scanned facet parameters. The gem scanner 310 may be placed in vicinity of the turntable 305 so as to enable the plurality of facets of the actual gemstone to be scanned. Furthermore, as shown in FIG. 3, the system 300 also includes a control module 315 that may be operatively coupled to the gem scanner 310 so as to receive the scanned facet parameters of the actual gemstone. The control module 315 comprises a display screen and a pointer or an input device (not shown) as are known in the art so as to display the actual gem and/or a model of the actual gemstone, and to facilitate the designation of specific actual facets for further analysis. The operation of the system 300 so as to enable the control of the cutting of the actual gemstone shall now be explained in detail in conjunction with the method 200.

As shown in FIG. 2, the method 200 commences at 202 with the actual gemstone being placed upon the turntable 305. At 204, the gem scanner 310 may be used to scan the plurality of facets of the actual gemstone. More particularly, upon scanning the actual gemstone, the gemstone scanner 310 determines the scanned facet parameters pertaining to each one of the plurality of facets of the actual gemstone. In accordance with one embodiment of the present invention, the scanned facet parameters may include areas and angles of the facets. Furthermore, in accordance with one embodiment of the present invention, the plurality of facets may be selected from a group consisting of crown facets, pavilion facets, star facets, lower half facets, happer girdle facets and table facets. The facets of the actual gemstone scanned by the gem scanner 310 may henceforth be referred to as the "actual facet". Furthermore, the present invention will be explained by considering scanned facet parameters with respect to the actual table facets, actual crown facets, and actual pavilion facets of the actual gemstone only. However, the scope of the present invention should not be construed to be limited to the measurement of these actual facets only, and a determination of scanned facet parameters of any other actual facets in combination with, or in exclusion of, these actual facets would also lie within the scope of the present invention.

Thus, the gem scanner 310 determines, in accordance with one embodiment of the present invention, the angles and areas pertaining to the actual table facets, actual pavilion facets and actual crown facets of the actual gemstone. As shown in FIG. 2, the method 200, at 206, further comprises generating an actual 3D model of the actual gemstone from the scanned facet parameters of the actual facets thereof. Particularly, the control module 315 is adapted to generate the actual three-dimensional model from the scanned facet parameters by using conventional methods. More particularly, the control module 315 may calculate an average of the scanned facet parameters of the actual facets of the same kind and may integrate the same so as to generate the actual 3D model of the actual gemstone.

In addition, the control module 315 may generate an idealized 3D model corresponding to an idealized or optimal gemstone. In this regard, the term "idealized or optimal gemstone" may refer to a gemstone having ideal or optimal facet parameters of various facets such that the idealized or optimal gemstone exhibits desired brilliance, color and clarity characteristics. Furthermore, in this regard, the general gemstone 100 shown in FIG. 1*a* may be considered as an idealized gemstone having the ideal facet parameters, such as the size and angle of its various facets, such as crown facets 105*a*, 105*b*, and 105*c*, pavilion facets 110*a*, and the table 115. The various facets of the idealized gemstone 100 may be henceforth referred to as "idealized facet" and the facet parameters of the idealized facets would be henceforth referred to as "idealized facet parameters". More particularly, the control module 315 may be adapted to determine the average of the idealized facet parameters of same kind of idealized facets, and thereafter to normalize all idealized facets of the same kind to the averaged idealized facet parameter. In this regard, it is to be noted that the control module 315 may determine the average idealized facet parameters only for those idealized facets which correspond to the actual facets considered for generating the actual 3D model. Thus, in the described embodiment, the control module 315 may determine the average idealized facet parameters of each of the idealized table facet, idealized crown facets and idealized pavilion facets of the idealized gemstone, corresponding to the actual table, actual crown and actual pavilion facets of the actual gemstone, and to generate the idealized 3D model therefrom.

The present invention further envisages that, at 208, the actual 3D model may be compared by the control module 315 with the idealized 3D model so as to determine any leakage values between each of the scanned facet parameters of the actual facets of the actual gemstone as compared to the parameters of the idealized facets of the idealized gemstone 100. More particularly, these leakage value may be representative or indicative of any variations between the values of each one of the scanned facet parameters of the actual facets of the actual gemstone, as compared to the corresponding facets of the idealized gemstone 100, so as to effectively render the same similar to the idealized facet parameters of the corresponding idealized facets of the idealized gemstone 100. For instance, a leakage value with respect to the area and angle of the actual table facet may be representative or indicative of the difference or variation from the scanned facet parameters of the area and angle of the idealized table facet. In a similar manner, leakage values for actual pavilion facets and actual crown facets may likewise be determined.

Continuing further, the present invention envisages comparing the actual 3D model with the idealized 3D model, and the control module 315 may generate a first set of two dimensional models for each of the actual facets of the actual gemstone to be considered in connection with the generation of the actual 3D model. In the described embodiment, the control module 315 may generate the first set of two dimensional models including two separate two dimensional models with respect to the actual table, actual crown, and actual pavilion facets. More particularly, the scanned facet parameters of these actual facets may be used for generating the first set of two dimensional models. It is to be noted that the first set of two dimensional models may be generated from the actual 3D model by using known techniques. Similarly, a second set of two dimensional models may be generated from the idealized 3D model. It will be evident that the second set of two dimensional models may be only for those idealized facets of the idealized gemstone 100 which correspond to actual facets considered for generating the first set of two dimensional models. Thus, in the described embodiment, two sets of two dimensional models with respect to the idealized table, idealized crown, and idealized pavilion facets of the idealized gemstone 100 may be generated by the control module 315 by using the idealized facet parameters of the idealized facets considered.

Once the first set and the second set of two dimensional models have been generated, the control module 315 may superimpose each one of the first set of two dimensional models over a corresponding one of the second set of two dimensional models, as shown in FIGS. 4*a*, 4*b* and 4*c*. More particularly, FIG. 4*a* illustrates two dimensional models of the actual crown facets 405*a* of the actual gemstone superimposed over that of the corresponding idealized crown facets 105 of the idealized gemstone 100, FIG. 4*b* illustrates two dimensional models of the actual table facet 415 of the actual gemstone superimposed over that of the corresponding idealized table facet 115 of the idealized gemstone 100, and FIG. 4*c* illustrates two dimensional models of actual pavilion facets 410*a* of the actual gemstone superimposed over that of the idealized pavilion facets 110*a* of the idealized gemstone 100.

Upon superimposing the facets of the first set and the corresponding facets of the second set, the control module 315 determines overlapping areas, any non-overlapping areas, and overhanging areas from the superimposed two dimensional models. More particularly, the overlapping areas represent the extent to which the scanned facet parameters of the actual facets of the actual gemstone are the same with respect to the idealized facet parameters of corresponding idealized facets of the idealized gemstone 100. On the other hand, the overhanging areas represent the leakage values for each of the actual facets of the actual gemstone. More particularly, they represent the variations between each one of the scanned facet parameters of the various actual facets of the actual gemstone to the corresponding facet parameters of the idealized gemstone 100 so as to configure the actual facets to be similar to the idealized facet parameters of the corresponding idealized facets of the idealized gemstone 100.

Referring back to FIG. 4*a*, the superimposed two dimensional model of the actual crown facets 405*a* of the actual gemstone over that of the idealized gemstone 100 is depicted. As is evident from the FIG. 4*a*, there may be a non-overlapping portions 505 between the superimposed actual crown facets 405*a* and the idealized crown facets 105*a*, an overlapping portion 510, and an overhanging portion 515. The overhanging portion 515 may represent the leakage value, that is, the difference between the facet parameter, such as size and/or angle, of the actual crown facet 405*a* with respect to the idealized crown facet 105*a*.

Referring again to FIG. 4*b*, the superimposed two dimensional model of the actual table facet 415 of the actual gemstone over the idealized table facet 115 of the idealized gemstone 100 is likewise depicted. As is evident from the figure, there may be a non-overlapping portion 520, an overlapping portion 525 and an overhanging portion 530, all existing between the superimposed actual table facet 415 and the idealized table facet 115. The overhanging portion 530 may represent the leakage value, that is, the difference between the facet parameter, such as the size and/or angle, of the actual table facet 415 with respect to the idealized table facet 115.

Similarly, referring back to FIG. 4*c*, the superimposed two dimensional model of the actual pavilion facets 410*a* of the actual gemstone over the idealized pavilion facets 110*a* of the idealized gemstone 100 is depicted. As is evident from the figure, there may be non-overlapping portions 535, an overlapping portion 540 and an overhanging portion 545, all existing between the superimposed actual pavilion facets 410*a* and the idealized pavilion facets 110*a*. The overhanging portion 545 may represent the leakage value, that is, the difference between the facet parameters, such as size and/or angle, of the actual pavilion facets 410*a* with respect to the idealized pavilion facets 110*a*.

Thus, the leakage values may be representative or indicative of the differences between the scanned facet parameters of the various actual facets of the actual gemstone with respect to the idealized facet parameters of the corresponding idealized facets of the idealized gemstone 100. Based upon the determined leakage value, the cut of each one of the actual facets, that is, the actual crown facets, the actual pavilion facets, and the actual table facets, as per the described embodiment, of the actual gemstone may be selectively altered so as to render the scanned facet parameters thereof similar to those of the corresponding idealized facets of the idealized gemstone 100. Similarly, the leakage values for other actual facets may be determined by the control module 315 and the determined leakage values may be used by a gem cutter/polisher for controlling the cutting of the actual facets to conform the same to the cuts of the idealized gemstone 100. The method 200 may conclude at 210 with the actual facets of the actual gemstone conforming to the idealized facets of the idealized gemstone 100.

Furthermore, in accordance with one embodiment of the present invention, the control module 315 may also include a display unit 320 coupled thereto that may be adapted to display the result of the superimposition of the first and second sets of the two dimensional models. More particularly, the display unit 320 may display the overlapping area, the non-overlapping areas, and the overhanging areas with different visual representation, such as colors, hatching patterns and the like. The benefit of this may be that the system 300 may even be used by illiterate or semi-skilled gemstone cutters/polishers who may be unable to understand the leakage values when expressed in terms of numbers. A visual indication of the overhanging area may provide the gemstone cutter/polisher with specific knowledge as to how to appropriately cut or polish the gemstone so as to achieve the idealized values of the facet parameters for each of the facets.

In view of the foregoing, it shall be evident that the present invention provides a unique system that may enable in controlling the cut of a gemstone in a simple, convenient and easy manner. It shall be further evident that the present invention may provide leakage values as visual indications thereby enabling the cutting of the gemstones with a corresponding reduction of intense human labour as required in conventional processes. Moreover, the present invention may be especially useful for illiterate or semi-skilled gemstone cutters or processors who, by looking at the visual indications of the leakage values, may easily determine the variations in the cutting of the gemstones required so as to match the cuts of the idealized gemstones.

All directional references (such as, but not limited to, upper, lower, upward, downward, left, right, leftward, rightward, top, bottom, above, below, vertical, horizontal, clockwise, and counterclockwise, tangential, axial and/or radial, or any other directional and/or similar references) are only used for identification purposes to aid the reader's understanding of the embodiments of the present disclosure, and may not create any limitations, particularly as to the position, orientation, or use unless specifically set forth in the claims. Similarly, joinder references (such as, but not limited to, attached, coupled, connected, and the like) are to be construed broadly and may include intermediate members between a connection of elements and relative movement between elements. As such, joinder references may not necessarily infer that two elements are directly connected and in fixed relation to each other.

Additionally, all numerical terms, such as, but not limited to, "first", "second", "third", or any other ordinary and/or numerical terms, should also be taken only as identifiers, to assist the reader's understanding of the various embodiments, variations and/or modifications of the present disclosure, and may not create any limitations, particularly as to the order, or preference, of any embodiment, variation and/or modification relative to, or over, another embodiment, variation and/or modification.

Similarly, adjectives such as, but not limited to, "articulated", "modified", or similar, should be construed broadly, and only as nominal, and may not create any limitations, not create any limitations, particularly as to the description, operation, or use unless specifically set forth in the claims.

In methodologies directly or indirectly set forth herein, various steps and operations are described in one possible order of operation, however those skilled in the art will recognize that steps and operations may be rearranged, replaced, or eliminated without necessarily departing from the spirit and scope of the present disclosure as set forth in the claims. It is intended that all matter contained in the above description or shown in the accompanying drawings shall be interpreted as illustrative only and not limiting. Changes in detail or structure may be made without necessarily departing from the spirit of the present disclosure as defined in the appended claims.

While certain exemplary embodiments have been described and shown in the accompanying drawings, it is to be understood that such embodiments are merely illustrative of and not restrictive on the broad present disclosure, and that this present disclosure not be limited to the specific constructions and arrangements shown and described, since various other modifications and/or adaptations may occur to those of ordinary skill in the art. It is to be understood that individual features shown or described for one embodiment may be combined with individual features shown or described for another embodiment. It is to be understood some features are shown or described to illustrate the use of the present disclosure in the context of functional elements and such features may be omitted within the scope of the present disclosure and without necessarily departing from the spirit of the present disclosure as defined in the appended claims.

I claim:

1. A system for grading a cut of a gemstone, the system comprising:

a gem scanner adapted to scan plurality of actual facets of an actual cut or polished gemstone and determine scanned facet parameters pertaining to individual actual cut or polished facets of the plurality of actual facets; and a control module communicably coupled to the gem scanner to receive the determined scanned facet parameters of the plurality of actual cut or polished facets of the actual gemstone, wherein the control module is adapted to generate an actual 3D model for the actual gemstone from the scanned facet parameters and an idealized 3D model for an idealized gemstone by generating idealized facet parameters of idealized versions of the actual facets of the actual gemstone under assessment, wherein the idealized 3D model is generated by averaging idealized facet parameters of groups of idealized facets of the same kind on the same gemstone and normalizing those idealized facets of the gemstone to the averaged idealized facet parameter;

and wherein the control module is adapted to determine a quality of the cut of the actual gemstone, wherein the determination is made based at least in part on comparing the actual 3D model with the idealized 3D model by superimposing the actual 3D model over the idealized 3D model to determine overlapping areas, non-overlapping areas, and overhanging areas between the plurality of actual facets of the actual gemstone and corresponding idealized facets of the idealized gemstone.

2. The system as claimed in claim 1, wherein an operator selects which groups of facets of the same kind on the same gemstone are considered for creating the idealized 3D model.

3. The system as claimed in claim 1, wherein the actual 3D model is displayed and wherein an operator selects which groups of facets of the same kind on the same gemstone are considered for quality assessment.

4. The system as claimed in claim 1, wherein the scanned and idealized facet parameters comprise areas.

5. The system as claimed in claim 1, wherein the control module is adapted to compare the actual 3D model with the idealized 3D model by generating a first set of two dimensional models for individual actual facets of the plurality of actual facets of the actual gemstone from the actual 3D model and a second set of two dimensional models for corresponding idealized facets of the idealized gemstone from the idealized 3D model, and to superimpose the first set of two dimensional models over corresponding second set of two dimensional models so as to determine an overhanging region therebetween, the overhanging region representing a quality assessment value for the scanned facet parameters of individual actual facets of the plurality of actual facets relative to the idealized versions of the actual facets.

6. The system as claimed in claim 5, wherein the quality assessment value for the scanned facet parameters represents a difference between the Scanned facets parameters of actual facets of the actual gemstone and corresponding idealized facets of the idealized gemstone.

7. A method for controlling the cut of a gemstone, the method comprising:

Scanning a plurality of actual facets of an actual cut or polished gemstone and determining scanned facet parameters pertaining to individual actual cut or polished facets of the plurality of actual facets; and generating an actual 3D model for the actual gemstone from the determining facet parameters of the actual cut or polished facets;

generating an idealized 3D model for an idealized gemstone based solely on the scanned facet parameters of the actual cut or polished gemstone under assessment, wherein generating the idealized 3D model comprises averaging idealized facet parameters of groups of idealized facets of the same kind on the same gemstone and normalizing those idealized facets of the same kind to an averaged idealized facet parameter; and determining a quality of the cut of the actual gemstone, wherein the determination is made based at least in part on comparing the actual 3D model with the idealized 3D model by superimposing the actual 3D model over the idealized 3D model to determine overlapping areas, non-overlapping areas, and overhanging areas between actual facet parameters of individual actual facets of the actual gemstone and corresponding idealized facets of the idealized gemstone.

8. The method as claimed in claim 7, wherein comparing the actual 3D model with the idealized 3D model comprises generating a first set of two dimensional models for individual actual facets of the plurality of actual facets of the actual gemstone from the actual 3D model and a second set of two dimensional models for corresponding idealized facets of the idealized gemstone from the idealized 3D model, and superimposing the first set of two dimensional models over corresponding second set of two dimensional models so as to determine an overhanging region therebetween, the overhanging region representing a quality assessment value for scanned facet parameters of individual actual facets of the plurality of actual facets relative to the idealized facets of same said facets.

9. The method as claimed in claim 7, wherein controlling the cut of the gemstone based on the overlapping areas, non-overlapping areas, and overhanging areas comprises cutting individual actual facets of the actual facets so as to make the scanned facet parameters thereof similar to that of corresponding idealized facets of the idealized gemstone.

10. The method as claimed in claim 7, further comprising the step of assessing the cut of the gemstone based on the overlapping areas, non-overlapping areas, and overhanging areas between individual actual facets of the plurality of actual facets and that of corresponding idealized facets of the idealized gemstone.

* * * * *